US006426722B1

(12) United States Patent
Sievenpiper et al.

(10) Patent No.: US 6,426,722 B1
(45) Date of Patent: Jul. 30, 2002

(54) POLARIZATION CONVERTING RADIO FREQUENCY REFLECTING SURFACE

(75) Inventors: Daniel Sievenpiper, Los Angeles; Hui-Pin Hsu, Northridge, both of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/520,503

(22) Filed: Mar. 8, 2000

(51) Int. Cl.[7] ..... H01Q 1/36

(52) U.S. Cl. ..... 343/700 MS; 343/909; 343/910

(58) Field of Search ..... 343/700 MS, 725, 343/726, 727, 728, 729, 730, 753, 755, 909, 910

(56) References Cited

U.S. PATENT DOCUMENTS

| | | | | |
|---|---|---|---|---|
| 3,267,480 | A | 8/1966 | Lerner | 343/911 |
| 3,810,183 | A | 5/1974 | Krutsinger et al. | 343/708 |
| 3,961,333 | A | 6/1976 | Purinton | 343/872 |
| 4,150,382 | A | 4/1979 | King | 343/754 |
| 4,266,203 | A | 5/1981 | Saudreau et al. | 333/21 |
| 4,387,377 | A | 6/1983 | Kandler | 343/756 |
| 4,594,595 | A | 6/1986 | Struckman | 343/770 |
| 4,749,996 | A | 6/1988 | Tresselt | 343/700 |
| 4,782,346 | A | 11/1988 | Sharma | 343/795 |
| 4,843,400 | A | 6/1989 | Tsao et al. | 343/700 |
| 4,843,403 | A | 6/1989 | Lalezari et al. | 343/767 |
| 4,853,704 | A | 8/1989 | Diaz et al. | 343/767 |
| 4,905,014 | A | 2/1990 | Gonzalez et al. | 343/909 |
| 5,021,795 | A | 6/1991 | Masiulis | 343/700 |
| 5,023,623 | A | 6/1991 | Kreinheder et al. | 343/725 |
| 5,081,466 | A | 1/1992 | Bitter, Jr. | 343/767 |
| 5,115,217 | A | 5/1992 | McGrath et al. | 333/246 |

(List continued on next page.)

FOREIGN PATENT DOCUMENTS

| | | |
|---|---|---|
| DE | 196 00 609 A1 | 4/1997 |
| EP | 0 539 297 | 4/1993 |
| FR | 2 785 476 | 5/2000 |
| GB | 2 281 662 | 3/1995 |
| GB | 2 328 748 | 3/1999 |
| WO | 94/00891 | 1/1994 |
| WO | 96/29621 | 9/1996 |
| WO | 98/21734 | 5/1998 |
| WO | 99/50929 | 10/1999 |
| WO | 00/44012 | 7/2000 |

OTHER PUBLICATIONS

Balanis, C., "Aperture Antennas", *Antenna Theory, Analysis and Design*, 2nd Edition, (New York, John Wiley & Sons, 1997), Chap. 12, pp. 575–597.

Balanis, C., "Microstrip Antennas", *Antenna Theory, Analysis and Design*, 2nd Edition, (New York, John Wiley & Sons, 1997), Chap. 14, pp. 722–736.

(List continued on next page.)

*Primary Examiner*—Don Wong
*Assistant Examiner*—Shih-Chao Chen
(74) *Attorney, Agent, or Firm*—Ladas & Parry

(57) ABSTRACT

A polarization converting surface for reflecting impinging radio frequency waves. The surface includes a ground plane and a plurality of elements disposed in an array a distance from the ground plane. Each element is preferably connected to the ground plane by a conductor, the array of elements having two major axes associated therewith. The elements have a first bandwidth corresponding to a first range of frequencies were a first reflection phase falls between $-\pi/2$ and $+\pi/2$ in a first one of said two major axes and a second bandwidth corresponding to a second range of frequencies were a second reflection phase falls between $-\pi/2$ and $+\pi/2$ in a second one of said two major axes. The first and second bandwidths partially overlap and preferably an upper half of one of the bandwidths overlies a lower half of the other one of the bandwidths.

51 Claims, 7 Drawing Sheets

U.S. PATENT DOCUMENTS

Figure 1:
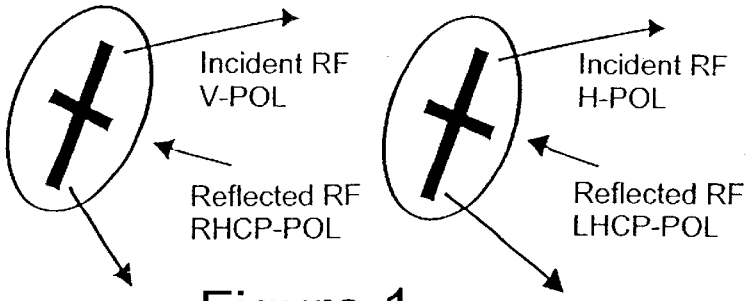
Figure 1 (Prior Art)

| | | | | | |
|---|---|---|---|---|---|
| 5,146,235 | A | | 9/1992 | Frese | 343/895 |
| 5,158,611 | A | | 10/1992 | Ura et al. | 106/499 |
| 5,268,701 | A | | 12/1993 | Smith | 343/767 |
| 5,287,118 | A | | 2/1994 | Budd | 343/909 |
| 5,519,408 | A | | 5/1996 | Schnetzer | 343/767 |
| 5,525,954 | A | | 6/1996 | Komazaki et al. | 333/219 |
| 5,531,018 | A | | 7/1996 | Saia et al. | 29/622 |
| 5,534,877 | A | | 7/1996 | Sorbello et al. | 343/700 |
| 5,541,614 | A | | 7/1996 | Lam et al. | 343/792.5 |
| 5,557,291 | A | | 9/1996 | Chu et al. | 343/725 |
| 5,589,845 | A | | 12/1996 | Yandrofski et al. | 343/909 |
| 5,611,940 | A | | 3/1997 | Zettler | 73/514 |
| 5,638,946 | A | | 6/1997 | Zavracky | 200/181 |
| 5,694,134 | A | | 12/1997 | Barnes | 343/700 |
| 5,721,194 | A | | 2/1998 | Yandrofski et al. | 505/210 |
| 5,874,915 | A | | 2/1999 | Lee et al. | 342/375 |
| 5,894,288 | A | | 4/1999 | Lee et al. | 343/770 |
| 5,923,303 | A | | 7/1999 | Schwengler et al. | 343/853 |
| 5,945,951 | A | | 8/1999 | Monte et al. | 343/700 |
| 5,949,382 | A | | 9/1999 | Quan | 343/767 |
| 6,005,519 | A | | 12/1999 | Burns | 343/700 |
| 6,040,803 | A | | 3/2000 | Spall | 343/700 |
| 6,054,659 | A | | 4/2000 | Lee et al. | 200/181 |
| 6,075,485 | A | * | 6/2000 | Lilly et al. | 343/700 MS |
| 6,081,235 | A | | 6/2000 | Romanofsky et al. | 343/700 |
| 6,097,263 | A | | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,127,908 | A | | 10/2000 | Bozler et al. | 333/246 |
| 6,154,176 | A | * | 11/2000 | Fathy et al. | 343/700 MS |
| 6,166,705 | A | | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,246,377 | B1 | | 6/2001 | Aiello et al. | 343/770 |

OTHER PUBLICATIONS

Cognard, J., "Alignment of Nematic Liquid Crystals and Their Mixtures" *Mol. Cryst. Liq, Cryst*. Suppl. 1, 1 (1982)pp. 1–74.

Doane, J.W., et al., "Field Controlled Light Scattering from Nematic Microdroplets", *Appl. Phys. Lett.*, vol. 48 (Jan. 1986) pp. 269–271.

Jensen, M.A., et al., "EM Interaction of Handset Antennas and a Human in Personal Communications", *Proceedings of the IEEE*, vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation*, vol. 42, No. 8 (Aug. 1994) pp. 1106–1113.

Ramo, S., et al., *Fields and Waves in Communication Electronics*, 3rd Edition (New York, John Wiley & Sons, 1994) Section 9.8—9.11, pp. 476–487.

Sievenpiper, D., et. al., "High–Impedance Electromagnetic Surfaces with a Forbidden Frequency Band", *IEEE Transactions on Microwave Theory and Techniques*, vol. 47, No. 11, (Nov. 1999) pp. 2059–2074.

Sievenpiper, D., "High–Impedance Electromagnetic Surfaces", Ph.D. Dissertation, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett*. vol. 74, No. 5, (Jan. 1999) pp. 344–346.

Bradley, T. W., et al., "Development of a Voltage–Variable Dielectric (VVD), Electronic Scan Antenna," *Radar 97*, Publication No. 449, pp. 383–385 (Oct. 1997).

Ellis, T. J. and G. M. Rebeiz, "MM–Wave Tapered Slot Antennas on Micromachined Photonic Bandgap Dielectrics," 1996 *IEEE MTT–S International Microwave Symposium Digest*, vol. 2, pp. 1157–60 (1996).

Linardou, I., et al., "Twin Vivaldi antenna fed by coplanar waveguide," *Electronics Letters*, vol. 33, No. 22, pp. 1835–7 (Oct. 23, 1997).

Schaffner, J. H., et al., "Reconfigurable Aperture Antennas Using RF MEMS Switches for Multi–Octave Tunability and Beam Steering" *IEEE*, pp. 321–4 (2000).

Sievenpiper, D., et al., "Low–profile, four–sector diversity antenna on high–impedance ground plane," *Electronics Letters*, vol. 36, No. 16, pp. 1343–5 (Aug. 3, 2000).

Sievenpiper, D. and Eli Yablonovitch, "Eliminating Surface Currents with Metallodielectric Photonic Crystals," 1998 *IEEE MTT–S International Microwave Symposium Digest*, vol. 2, pp. 663–666 (Jun. 7, 1998).

* cited by examiner

POLARIZATION CONVERTING RADIO FREQUENCY REFLECTING SURFACE

TECHNICAL FIELD

The present invention provides a reflective surface which is capable of converting polarization of a radio frequency signal, such as microwave signal, between linear and circular, for use in various antenna applications.

BACKGROUND OF THE INVENTION

The polarization converting reflector of the present invention is based on a Hi-Z surface, in which the electromagnetic surface impedance is controlled differently in two orthogonal directions by appropriately distributing resonant LC circuits on a conducting sheet. In accordance with the present invention, the surface impedance 'seen' by an incoming wave or by adjacent antenna elements is different along two orthogonal axes of the surface. For an incoming wave with linear polarization, the reflection phase depends on the angle of the polarization with respect to the two axes of the surface. In the polarization converting reflector, polarization phase is designed to differ by $\pi/2$ to for the two orthogonal directions. A wave which is linearly polarized at 45 degrees with respect the two axes is converted into a circularly polarized wave upon reflection. Similarly, and incoming circularly polarized wave is converted into a linearly polarized and wave upon reflection. Furthermore, both right-hand and left-hand circular polarization can be produced from orthogonal linearly polarized waves. When used as a reflector for an antenna, this surface is capable of collecting a circularly polarized beam from a satellite and focusing it onto a linearly polarized detector. This surface may also be used as a ground plane for a phased array having individual antenna elements comprised of straight wires, yet the array is capable of radiating a circularly polarized radio frequency signal because of the presence of the polarization converting reflecting surface disclosed herein.

The concept of using a resonant structures to convert between linear and circular polarization is not new. An array consisting of pairs of orthogonal dipoles having slightly different resonant frequencies has been disclosed by Gonzolez et. al. (U.S. Pat. No. 4,905,014). By designing the dipoles such that the reflection phase differs by $\pi/2$, the same polarization converting effect can be achieved. However, this structure requires the presence of a separate ground plane, which must be one-quarter wavelength behind the dipoles. Depending on the operating frequency, this could lead to a rather thick structure, which may be unacceptable for some applications. The present invention is much better, on the order of one-tenth of the wavelength or less. Furthermore, the Gonzolez asserts that the device only has a bandwidth of 3 percent to 10 percent using his dipole design. With the present invention, experimental data suggest a bandwidth of 10 to 20% of the center frequency of interest should be achievable.

The present invention also supersedes several current techniques for transmitting and receiving in circular polarization. By converting between circular and linear polarization, this reflector eliminates the need for a circularly polarized detector. A simpler detector having linear polarization can be used instead. Furthermore, this invention has advantages for circularly polarized phased arrays. In general, antenna elements which radiate or receive in circular polarization tend cover a large area, while linear elements can be thin, wire dipoles. Since narrow wire elements use very little area on the surface of the array, adjacent elements can be separated by a large distance. This can be used to improve isolation and eliminate the phase error that results from inter-element interaction.

A polarization converting dipole reflector, disclosed by Gonzolez et al., is shown in FIG. 1. It consists of pairs of dipoles, oriented orthogonally with respect to each other. The dipoles have slightly different resonant frequencies, and are designed so that they reflect with a phase difference of $\pi/2$ between the two orientations. If a wave impinges one of the dipoles with linear polarization, oriented at 45 degrees with respect to the other dipole, it will have circular polarization after reflection. This is due to the fact that the component oriented along one dipole is delayed with respect the compliment oriented along the other dipole by one-quarter cycle.

The Hi-Z surface, which is the subject of a provisional patent application filed by Sievenpiper et al (U.S. Ser. No. 60/079,953, filed on Mar. 30, 1998), provides a means of artificially controlling the impedance of the conducting surface by covering it with a periodic texture consisting of resonant LC circuits. These resonant LC circuits can be easily fabricated using printed circuit board technology, so the resulting structure is thin and inexpensive to build. At the resonant frequency, the structure can transform a low-impedance metal sheet into a high-impedance surface, allowing very thin antennas (having a thickness $<<\lambda$) to be mounted directly adjacent to it without being shorted out.

The Hi-Z surface typically consists of a pattern of small (having a size $<<\lambda$ in a direction parallel to the major surface which they define) flat metallic elements protruding from a flat metal sheet. They resemble thumbtacks, or flat mushrooms, arranged in a lattice or array on the metal surface, and can be fabricated in a single or multi-layer geometry. They are usually constructed as flat metal patches, each connected to the ground plane by a via, which is drilled through the circuit board substrate material and plated with metal. The proximity of the neighboring metal patches provides capacitance C, while the long conducting path between them provides inductance L. At the resonant frequency, $$\omega = \frac{1}{\sqrt{LC}},$$

this surface exhibits high impedance. Any desired surface impedance can be achieved simply by tuning the resonant frequency. An example of a Hi-Z surface is shown in FIG. 2*a* along with the measured reflection phase as a function of frequency in FIG. 2*b*.

BRIEF DESCRIPTIONS OF THE DRAWINGS

Figure 2A:
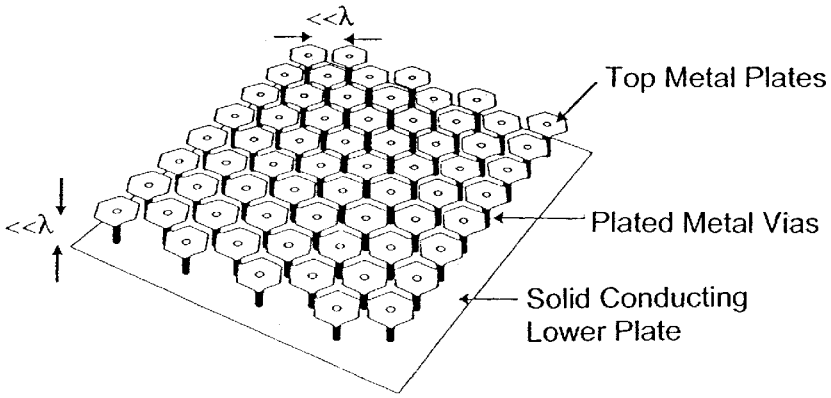
Figure 2a (Prior Art)
Figure 2B:
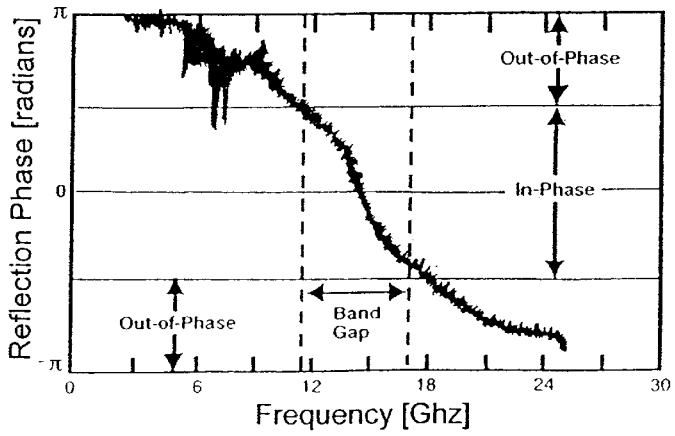
Figure 2b (Prior Art)

FIG. 1 depicts a resonant dipole structure of a type known in the prior art which consists of a pair of orthogonally disposed dipoles having slightly different resonant frequencies;

FIG. 2*a* is a perspective view of a Hi-Z surface of a type known in the prior art which includes an array of small resonant elements;

FIG. 2*b* is a graph of the measured reflection phase for the device of FIG. 2*a;*

Figure 3A:
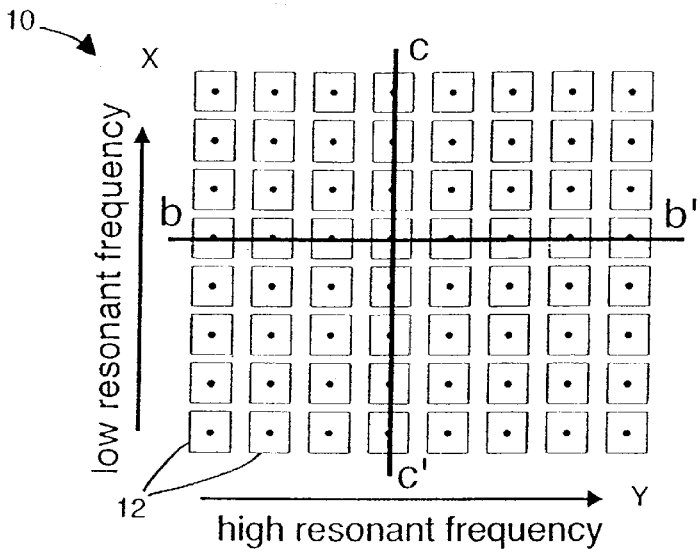
Figure 3B:
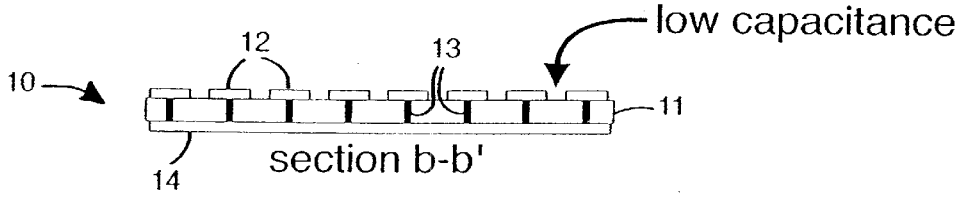
Figure 3C:
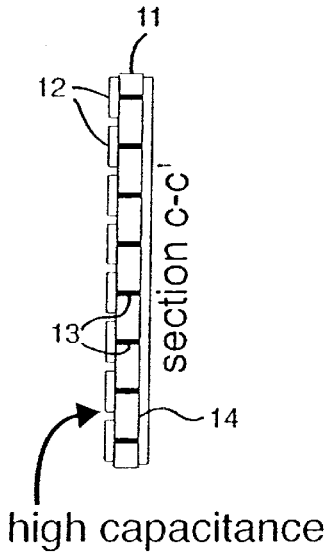
Figure 4A:
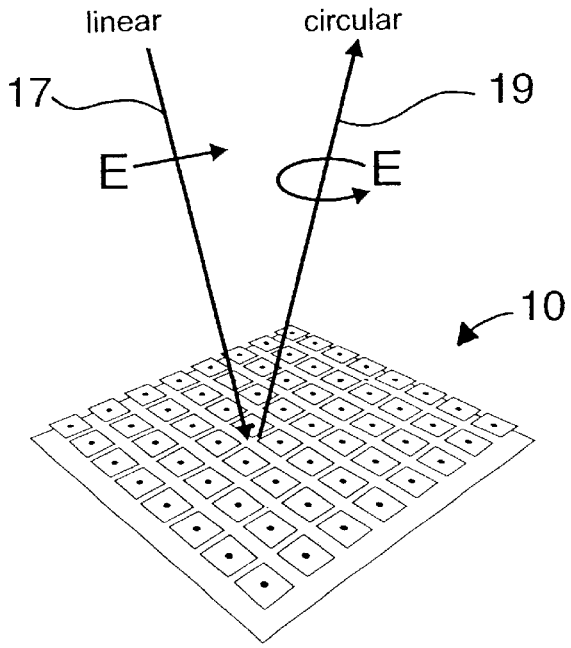
Figure 4B:
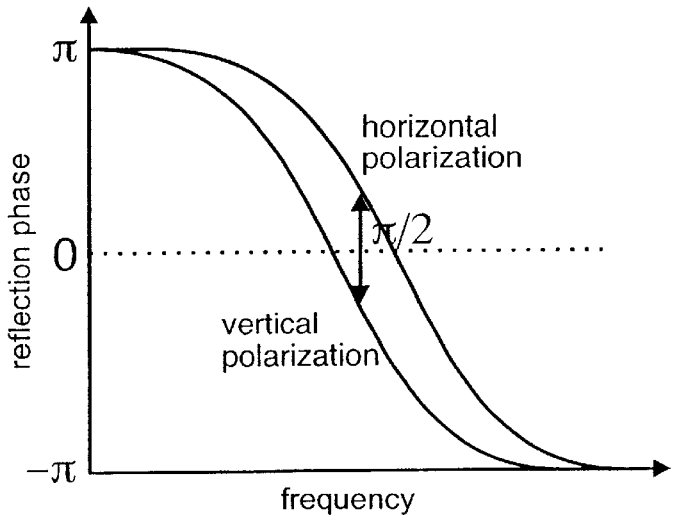

FIG. 3*a* is a plan view of an embodiment of a two layer polarization converting reflector in accordance with the present invention;

FIG. 3*b* is a section view taken through the polarization converting reflector shown in FIG. 3*a* along line b–b';

FIG. 3*c* is a section view taken through the polarization converting reflector shown in FIG. 3*a* along line c–c';

FIG. 4*a* is a perspective view of the polarization converting reflector of FIGS. 3*a* and 3*b* showing an impinging linearly polarized wave which is being reflected as a circularly polarized wave;

FIG. 4*b* is a graph of the reflected phase versus frequency for the device of FIGS. 3 and 4*a;*

Figure 5:
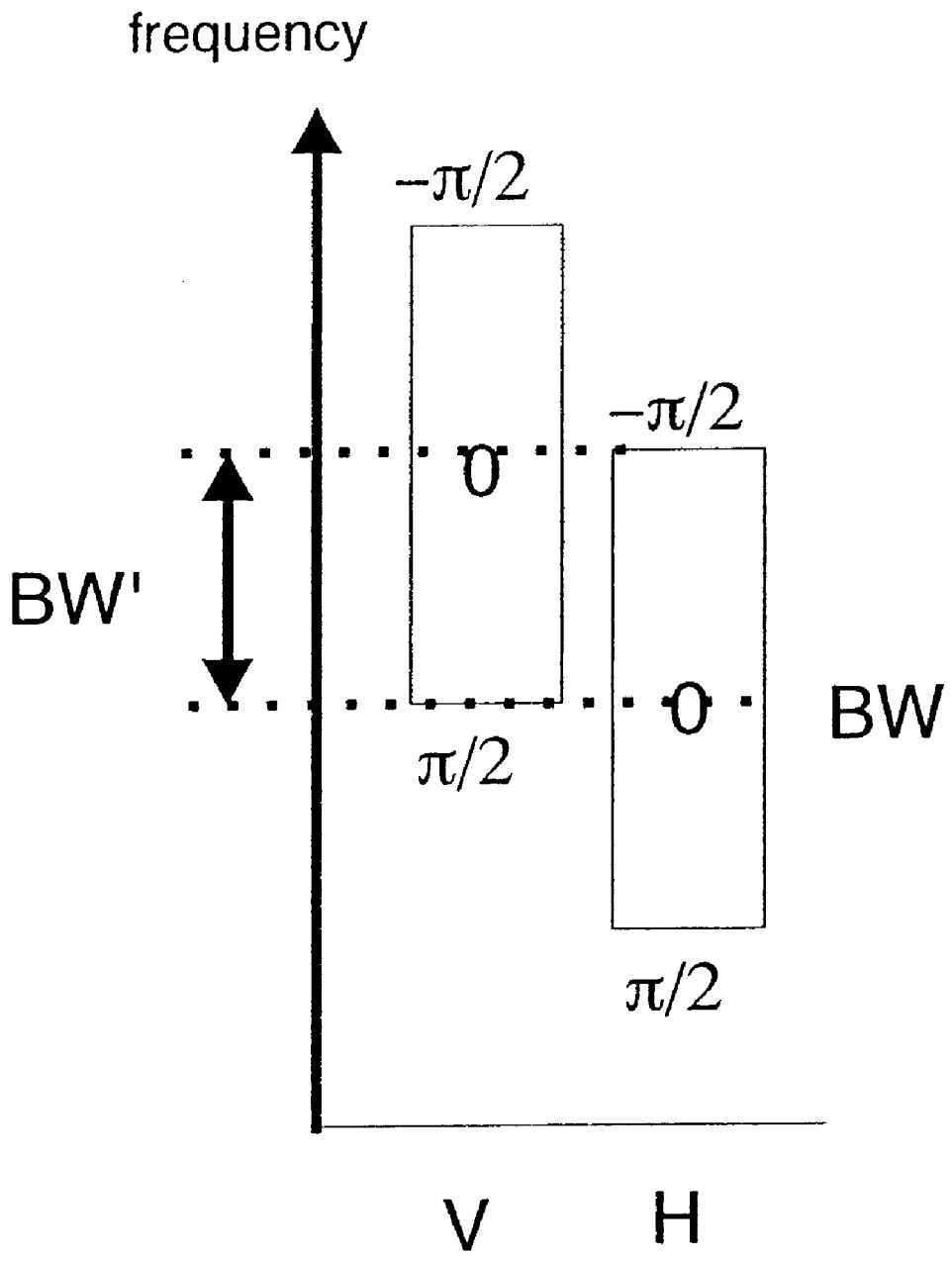
Figure 6A:
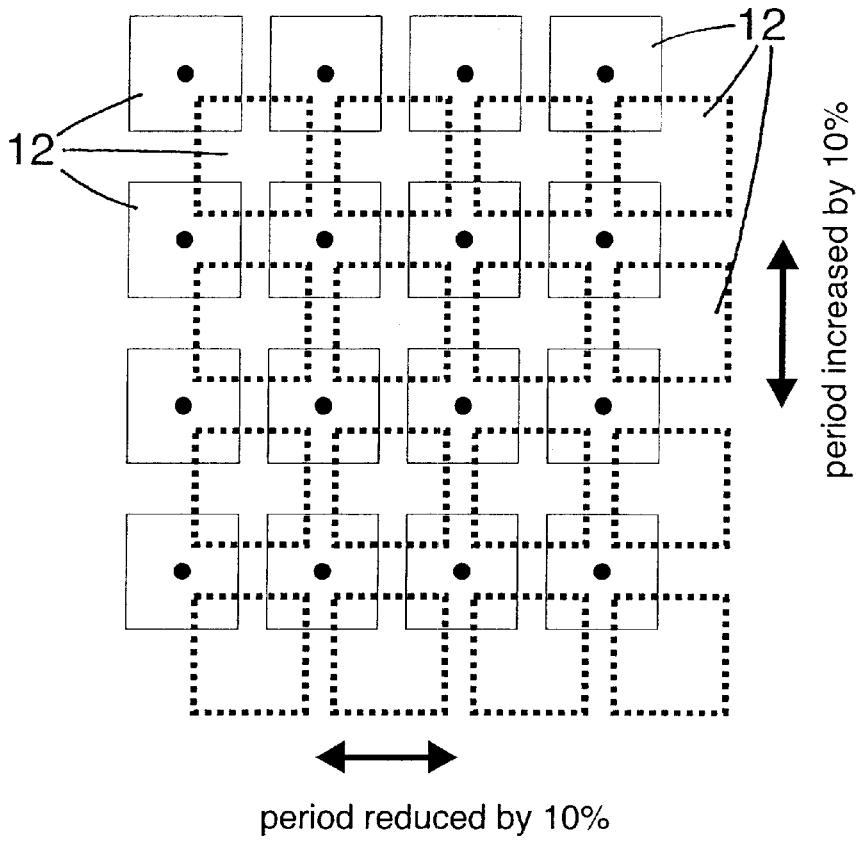
Figure 6B:
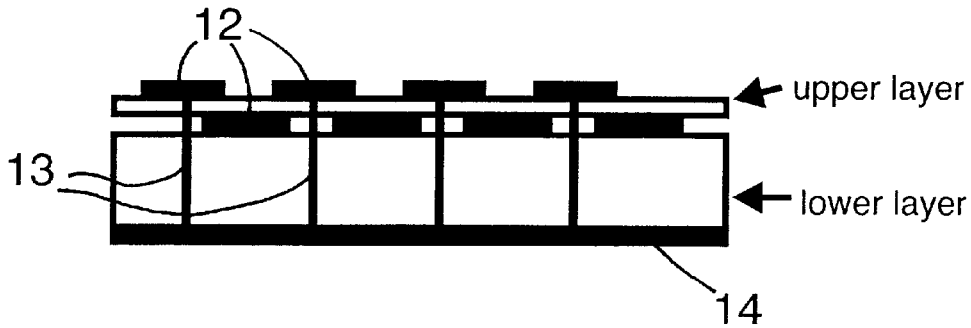

FIG. 5 depicts the relationship between the bandwidths of the pass bands in two orthogonal directions or axes;

FIG. 6*a* is a plan view of an embodiment of a three layer polarization converting reflector in accordance with the present invention;

FIG. 6*b* is a section view taken through the polarization converting reflector shown in FIG. 6*a;*

Figure 7:
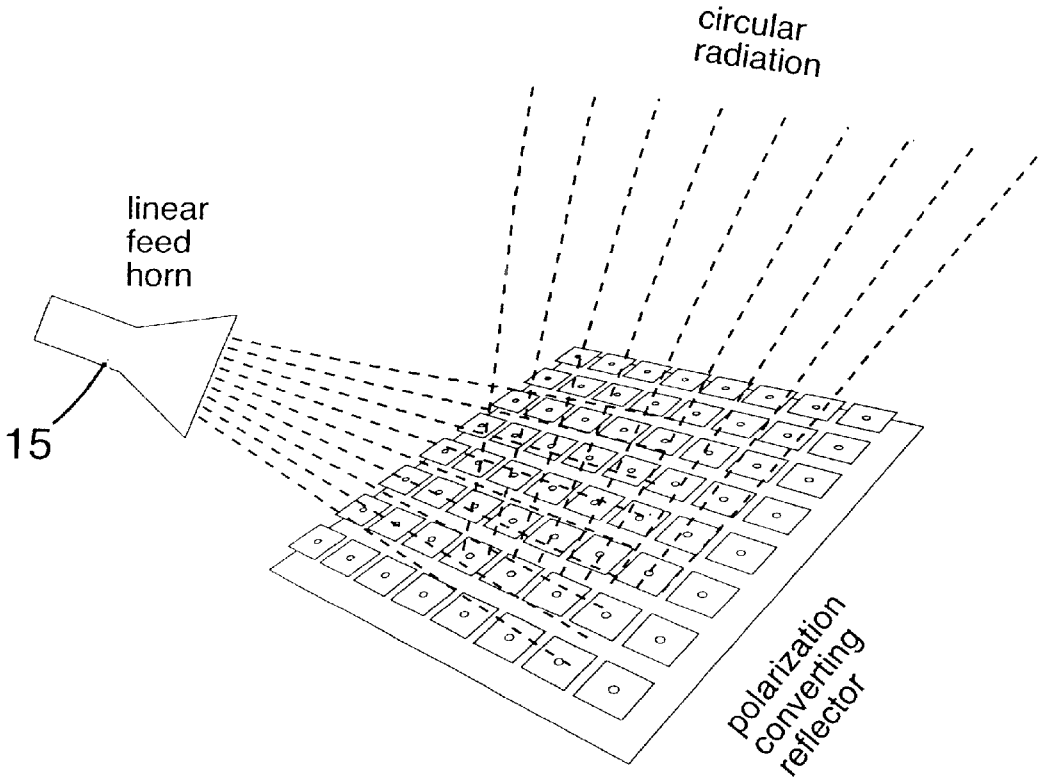
Figure 8A:
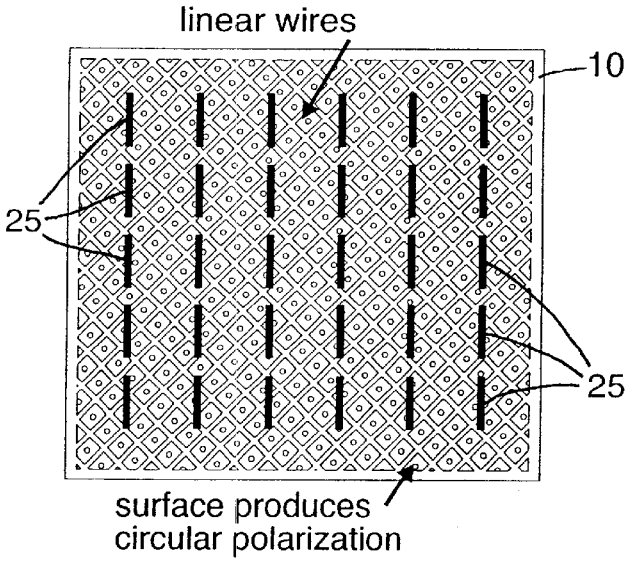
Figure 8B:
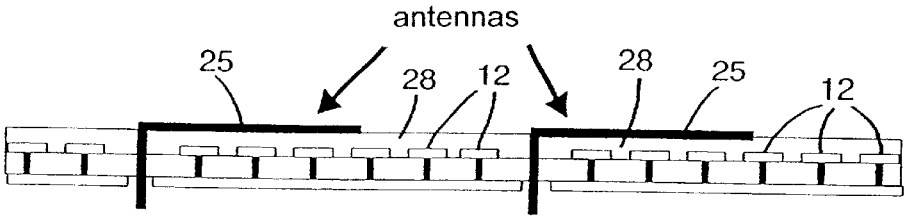

FIG. 7 depicts the polarization converting reflector being used with a linear feed horn of an antenna to convert the linear polarization of the feed horn to circularly polarized radiation;

FIG. 8*a* is a plan view the polarization converting reflector of FIGS. 3*a*, 3*b* and 4*a* in combination with an array of simple, low-profile, linear antenna elements, which radiate directly from the surface of the reflector;

FIG. 8*b* is a elevation view through the structure of FIG. 8*a*; and

Figure 8C:
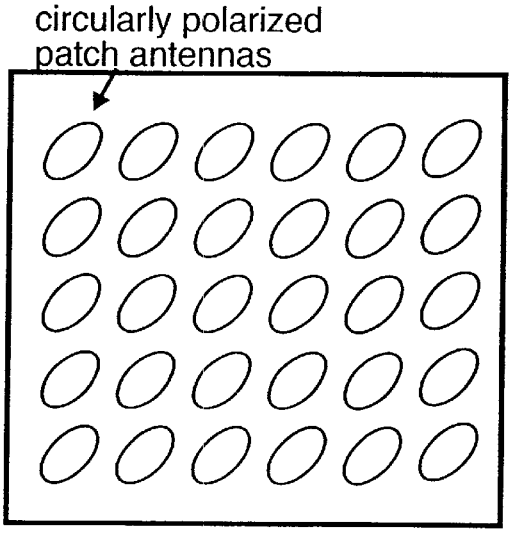

FIG. 8*c* depicts an array of circularly polarized patch antennas.

DETAILED DESCRIPTION

The present invention is an improvement of the Hi-Z surface of FIG. 2*a* so that the resonant frequency depends on the angle of polarization of incoming wave with respect the two axes of this surface. This effect is obtained by providing the Hi-Z surface with two different values of sheet capacitance along two primary, and typically orthogonal, directions, either by varying the value of the capacitors themselves, or by varying the periodicity of a lattice. An embodiment wherein the Hi-Z surface has two different values of sheet capacitance along its x and y axes is illustrated by FIGS. 3*a*, 3*b* and 3*c* as a structure in which the spacing along the horizontal or y direction is slightly greater than that along the vertical or x direction. This results in a lower capacitance and thus a higher resonant frequency along the horizontal or y direction.

When a wave of linear polarization is reflected by such as surface, its reflection phase depends on the angle of its polarization with respect to the two axes x and y of the surface. The structure of FIGS. 3*a*, 3*b* and 3*c* is designed such that, over a certain frequency band, it reflects horizontally polarized waves with a $+\pi/4$ phase shift and reflects vertically polarized waves with a $-\pi/4$ phase shift. If a wave impinges on the surface with its linear polarization oriented at 45 degrees with respect to each axis, then one component will be delayed by one-quarter cycle with respect to the other component. This has the effect of converting the impinging linear to reflected circular polarization.

FIG. 3*b* is a section view through the structure of FIG. 3*a* along line b–b' while FIG. 3*c* is a section view through the structure of FIG. 3*a* along line c–c'. The conducive elements or plates 12 may have any convenient configuration. They are depicted as being square in FIG. 3*a* as that is a convenient shape for the x axis and y axis orientation of the changing impedance across the surface of the structure. Each top plate or element 12 is preferably coupled to the conductive back plane 14 by a conductor 13. The plates or elements 12 are preferably of a planar configuration and are preferably formed on an upper major surface of substrate such as a printed circuit board or other sheet insulator 11, while the back plane 14 is formed on an opposite major surface of the substrate 11. Conductors 13 are preferably formed by forming vias in substrate 11 and plating through the vias with a metal using well known plating techniques.

The plates 12, while preferably being planar and preferably being formed on a single surface, do not need to share the same plane or surface. For example, a multi-layer geometry can be used in which the plates 12 are formed on different layers with the plates 12 of one layer partially overlapping the plates 12 of the other (or another) layer. Indeed in lower frequency applications a three layer structure is preferred and may be required. A three layer structure is shown by FIGS. 6*a* and 6*b* and is discussed below.

The basic concept of a polarization converting reflector is shown in FIGS. 4*a* and 4*b*. FIG. 4*b* is a graph which depicts both the required reflection phase as a function of frequency, for the horizontal and vertical components, and the resulting effect on a reflective wave. The surface is designed so that the reflection phase differs by $\pi/2$ for the horizontal and vertical components. When a linearly polarized wave 17 oriented at 45 degrees with respect to the horizontal or x and vertical or y axes is reflected from this surface 10, it appears as if one component has been delayed by one-quarter wavelength with respect to the other. As a result, a wave of linear polarization is converted to circular polarization 19 upon reflection and visa versa. Furthermore, orthogonal circular polarizations are converted to orthogonal linear polarizations in the same manner and also visa versa.

The structure has several advantages over prior art methods for converting polarization. It does not suffer from the inefficiencies of transmission-based systems, for which reflections are considered a loss. Since the structure works in reflection mode, it can be made 100 percent efficient. Compared to the dipole array of the Gonzolez et. al. patent, the present structure has the potential to have wider bandwidth with a thinner profile. The Gonzolez et. al. patent claims that a 3% to 10% bandwidth is achieved for a structure which is one-quarter wavelength thick. The present invention is easily capable of providing more than 10% bandwidth with a thickness of less than one-tenth wavelength, as will be described below.

Typically, the bandwidth the Hi-Z surface is $2\pi/\lambda$ where t is the thickness of the structure. For example, if a structure is roughly 1/60 of one wavelength thick, it will have a usable bandwidth of about 10%. The bandwidth BW of the Hi-Z surface is usually taken to be the range of frequencies were the reflection phase falls between $-\pi/2$ and $+\pi/2$. See FIG. 5. Since the the Hi-Z surface has two different values of sheet capacitance along its x and y axes as illustrated by FIGS. 3*a* and 6*a*, the center frequencies of pass bands associated with those two axes should differ even though the bandwidth BW of the pass band for each axis will be about the same (for a given thickness t, the bandwidths BW will be the same percentage of the center frequencies). In order for the Hi-Z surfaces of FIGS. 3*a* and 6*a* to have an effective bandwidth BW' over which they operate, the bandwidths BW along the two axes x and y should overlap as shown by FIG. 5. As can be seen from FIG. 5, if the center frequency of one pass band (where the phase is zero) is set to correspond to the edge of the other pass band (where the phase is either $-\pi/2$ and $+\pi/2$ according to the definition given above), then useable bandwidth BW' will equal about one-half the bandwidth BW of the Hi-Z surface, or approximately $\pi t/\lambda$. Outside this range, the surface appears similar to an ordinary flat sheet of metal and also supports many surface wave modes. Thus, in the case of the polarization converting reflector of the types shown in FIGS. 3*a* and 6*a*, the total useable bandwidth is approximately one half of the usual bandwidth of the Hi-Z surface. Each orthogonal direction or axis has a different resonant frequency, but the lower half bandwidth of one direction or axis should overlap the upper half bandwidth of the other direction or axis. In spite of this restriction, Hi-Z surfaces can be fabricated with a bandwidth BW as large as one octave, so relatively wide-band implementations of the present invention should not be particularly difficult to achieve.

A polarization converting reflector of desired characteristics can be made by the following equations set forth below, which provide useful information to a person who is skilled in the art for producing a structure with a desired operating frequency and bandwidth.

The useable bandwidth BW', expressed as a percentage, is given by the following equation, which is used, as a first step, to set the thickness t of the structure:

$$BW' = \frac{\pi t}{\lambda}$$

where t=overall thickness of the structure; and

λ=wavelength at the center of the operating band.

The next step is to determine the average capacitance $C_{av}$ between the resonant elements based on the following equation:

$$\omega = \frac{1}{\sqrt{LC_{av}}}$$

where

ω=angular frequency at the center of operating band; and

L=sheet inductance=$\mu$t.

The next up is to determine the value of sheet capacitance $C_{x,y}$ along the two orthogonal directions, x and y, given the following equation:

$$C_{x,y}=C_{av}(1\pm BW').$$

The capacitance values in each direction or axis are offset from an average capacitance $C_{av}$ by the factor noted above. Since the frequency depends on the inverse square root of the capacitance, the variation in frequency along the two axes x,y can be expanded in a power series to give $$f_{x,y} = f_{av}\left(1 \pm \frac{C_{av}}{2}\right)$$

where $f_{av}$ is the center frequency of the useable bandwidth BW'.

With respect to sizing the plates or elements 12 and spacing them on the substrate 11, the following explanation should prove helpful. In the case of a two layer structure such as that shown in FIGS. 3*a* and 3*b*, where the capacitance is produced by fringing electric fields, the formula for the capacitance is:

$$C = \frac{w(\epsilon_1 + \epsilon_2)}{\pi}\mathrm{Cosh}^{-1}\left(\frac{a}{g}\right)$$

where a=lattice constant along a particular direction;

g=the size of the gaps in the particular direction;

w=the width of the plates orthogonal to the particular direction; and $\epsilon_1$ and $\epsilon_2$ are the dielectric constant of the substrate 11 material and the material surrounding a region above the elements 12 (usually air or a vacuum, but other materials could be present).

In the case of a three layer structure, such as that shown by FIGS. 6*a* and 6*b*, where the capacitance is formed by overlapping capacitor plates, then the capacitance is given by the following formula:

$$C = \frac{\varepsilon A}{d}$$

where

ε=the dielectric constant of the material between the plate (usually the same as that of substrate 11);

A=the overlap areas of the plates; and d=the distance between the plates.

Since the elements 12 will have the same overlap area in both directions or axes, the sheet capacitance is preferably changed in the two directions or axes by changing the periodicity of the elements 12 along the two different axes. The periods $P_x$ and $P_y$ can be increased (or decreased) by a factor of 1±BW' to achieve the desired effect. Alternatively, one layer of plates 12 can be shifted relative to the other layer in one direction or axis relative to the other direction or axis to also achieve the desired effect.

By way of an example, assume that a polarization converting reflector having a useful bandwidth BW' of 10% and working at a center frequency of 10 GHz is desired and that a three layer structure such as that depicted by FIGS. 6*a* and 6*b* is utilized. From the first equation set forth above, the thickness should be about 1 mm for this bandwidth, which is only about 1/30 of the wavelength of 10 GHz. From the second equation, the average capacitance $C_{av}$ is determined that it should about 0.20 pF. Finally, from the third equation, the sheet capacitance along the two directions $C_x$ and $C_y$ should be 0.18 pF and 0.22 pF to achieve the desired results. Such a polarization converting reflector can be easy manufactured using printed circuit board technology. A suitable substrate 11 is Duroid 5880 sold by Rogers Corporation. The lower layer is preferaby 40 mils (1 mm) thick while the upper layer is preferably about 5 mils (0.13 mm) thick. The elements 12 on each layer are preferably 75 mils square (1.9 $mm^2$). The periodicity of the basic structure for this 10 Ghz example is about 100 mils (2.54 mm). The periodicity is increased by 10% in one direction and decreased by 10% in the other direction. This structure should work over a frequency range of approximately 9.5 to 10.5 GHz so its useful bandwidth BW' is indeed 10% of the center frequency.

Only one set of plates 12 (the upper set) is shown as being directly coupled to the ground or back plane 14 by conductors 13 in FIG. 6*b*. If the antenna is spaced at least one wavelength away from the surface of the Hi-Z surface, then such conductors 13 are unnecessary. If the antenna is spaced closer, then in order to suppress surface waves, conductors 13 for coupling at least the outer-most elements 12 to the ground or back plane 14 are needed. The conductors 13 are preferably directly coupled to the ground or back plane 14, unless signal are applied thereto the control other elements for controllably changing the capacitance of the Hi-Z sheet, in which case the conductors 13 are then at least capacitively coupled to the ground or back plane 14.

When the elements 12 are AC-coupled to the ground plane 14, then surface waves will be suppressed and the Hi-Z surface can have a zero reflection phase. A zero reflection phase is important, in some applications, since antenna elements can lie directly adjacent the Hi-Z surface. The suppression of surface waves is important in such applications because it improves the antenna's radiation pattern when the antenna is close enough that it would otherwise excite such surface waves (when within a wavelength or so). For example, if one or more antenna elements is mounted on or very near the polarization converting Hi-Z surface, such as the case of a dipole element adjacent or on the polarization converting Hi-Z surface, then it is very desirable to suppress the surface waves.

However, if the antenna is relatively far from the polarization converting Hi-Z surface (more than a wavelength), such as in the case of a feed horn illuminating the polarization converting Hi-Z surface, then suppression of surface waves is of less concern and AC-coupling the elements 12 to the ground plane 14 may be omitted. In such an embodiment the reflection phase can still be zero at some frequency and the surface is tunable using the techniques described herein. One use of such a structure is illustrated by FIG. 7, in which a linear antenna feed horn 15 is made to produce circular radiation after reflection from the polarization converting surface.

Another possible application of the polarization converting Hi-Z surface is shown in FIG. 8*a*, in which the surface serves as the ground plane for an array of low-profile linear antennas 25. Linear wire antennas on conventional Hi Z surfaces are efficient broadband radiators. Typically, the wire antennas 25 are about one-third wavelength long, and their performance is determined more by the Hi-Z surface than by the geometry of the wire itself. Preferably the wire antennas 25 are between $\lambda/2$ or $\lambda/4$ long and experience shows that a length of about $\lambda/3$ is often a good choice. The wire antennas 25 are kept out of contact with the top plates or patches 12 by a separate insulating layer 28 (see FIG. 8*b*). The antenna 25 works by exciting a leaky TE mode of the Hi-Z surface, which then radiates into free space. By orienting the wires 25 at 45 degrees with respect to the two axes x and y of the surface 10, two orthogonal modes can be excited that are out of phase by $\pi/2$ and thus radiate together in circular polarization. The advantage of this geometry is that the wires 25 themselves can be separated by one-half wavelength ($\lambda/2$), providing a high degree of isolation between the wire antenna elements 25 along one direction. This is shown in FIG. 8*a*, in which the wire antenna elements 25 are separated by a large distance in the horizontal direction. The separation along the vertical direction is less important, since the wire antenna elements 25 have a null in that direction. This geometry can be compared to array of circularly polarized patch antennas, illustrated by the ellipses in FIG. 8*c*, which have narrow separation for the same element spacing. FIG. 8*b* is a section view taken through the reflector shown in FIG. 8*a*.

In the embodiments shown by the drawings the polarization converting Hi-Z surface is depicted as being planar. However, the invention is not limited to planar polarization converting Hi-Z surfaces. Indeed, those skilled in the art will appreciate the fact that the printed circuit board technology preferably used to provide a substrate 11 for the polarization converting Hi-Z surface can provide a very flexible substrate 11. Thus the polarization converting Hi-Z surface can be mounted on any convenient surface and conform to the shape of that surface. The tuning of the impedance function would then be adjusted to account for the the shape of that surface. Thus, polarization converting Hi-Z surface can be planar, non-planar, convex, concave or have any other shape by appropriately tuning its surface impedance.

The top plate elements 12 and the ground or back plane element 14 are preferably formed from a metal such as copper or a copper alloy conveniently used in printed circuit board technologies. However, non-metallic, conductive materials may be used instead of metals for the top plate elements 12 and/or the ground or back plane element 14, if desired.

Having described the invention in connection with certain embodiments thereof, modification will now certainly suggest itself to those skilled in the art. As such, the invention is not to be limited to the disclosed embodiments except as required by the appended claims.

What is claimed is:

1. A surface for reflecting and changing polarization of a radio frequency beam, the surface comprising:

(a) a ground plane;

(b) a plurality of conductive elements disposed in at least one array and spaced from the ground plane, the at least one array being spaced a distance which is less than a wavelength of the radio frequency beam, the at least one array having two major axes associated therewith; and (c) the conductive elements being arranged with different sheet capacitances in said two major axes.

2. The surface of claim 1 further including an substrate having first and second major surfaces, said substrate supporting at least selected ones of said plurality of conductive elements on said first major surface thereof and supporting said ground plane on the second major surface thereof.

3. The surface of claim 2 wherein at least selected ones of said plurality of conductive elements are connected to said ground plane by conductors routed through said substrate.

4. The surface of claim 3 wherein the plurality of conductive elements each have an outside dimension which is less than the wavelength of the radio frequency beam.

5. The surface of claim 2 wherein the substrate has a thickness t which is less than 1/10th of the wavelength of the radio frequency beam.

6. The surface of claim 5 wherein the surface is a polarization converting reflecting surface for changing the polarization of the radio frequency beam from circular to linear and/or from linear to circular, wherein the plurality of conductive elements have a first bandwidth corresponding to a range of frequencies were the reflection phase falls between $-\pi/2$ and $+\pi/2$ in a first one of said two major axes and a second bandwidth corresponding to a range of frequencies were the reflection phase falls between $-\pi/2$ and $+\pi/2$ in a second one of said two major axes and wherein the first and second bandwidths partially overlap.

7. The surface of claim 6 wherein one of said first and second bandwidths includes higher frequencies than does the other one of said first and second bandwidths and wherein a lower half of said one bandwidth coincides with an upper half of said other bandwidth.

8. The surface of claim 7 wherein the substrate is a printed circuit board.

9. The surface of claim 2 further including a second substrate, the first-mentioned substrate supporting a first array of said conductive elements and the second substrate supporting a second array of said conductive elements, the conductive elements of the first and second arrays at least partially overlying each other.

10. The surface of claim 9 wherein the surface is a polarization converting reflecting surface for changing the polarization of the radio frequency beam from circular to linear and/or from linear to circular, wherein the top plates have a first bandwidth corresponding to a range of frequencies were the reflection phase falls between $-\pi/2$ and $+\pi/2$ in a first one of said two major axes and a second bandwidth corresponding to a range of frequencies were the reflection phase falls between $-\pi/2$ and $+\pi/2$ in a second one of said two major axes and wherein the first and second bandwidths partially overlap.

11. A polarization converting surface for reflecting radio frequency waves, the surface comprising:

(a) a ground plane;

(b) a plurality of conductive elements disposed in at least one array spaced from the ground plane, the at least one array of conductive elements having at least two major axes associated therewith, the conductive elements, in combination with the ground plane, having a first bandwidth corresponding to a first range of frequencies where a first reflection phase falls between $-\pi/2$ and $+\pi/2$ in a first one of said at least two major axes and a second bandwidth corresponding to a second range of frequencies where a second reflection phase falls between $-\pi/2$ and $+\pi/2$ in a second one of said at least two major axes and wherein the first and second bandwidths partially overlap.

12. The polarization converting surface of claim 11 wherein one of said first and second bandwidths includes higher frequencies than does the other of said first and second bandwidths and wherein the lower side band of said one bandwidth overlaps an upper side band of said other bandwidth.

13. The polarization converting surface of claim 11 further including a substrate for supporting said ground plane on one major surface thereof and for supporting at least selected ones of said plurality of conductive elements on another major surface thereof.

14. The polarization converting surface of claim 13 wherein said at least selected ones of said plurality of conductive elements are connected to said ground plane by conductors routed through said substrate.

15. The polarization converting surface of claim 14 wherein a majority of said plurality of elements are connected to said ground plane by conductors in said substrate.

16. The polarization converting surface of claim 13 wherein the plurality of conductive elements each have an outside dimension which is less than a wavelength of the radio frequency waves.

17. The polarization converting surface of claim 13 wherein the substrate has a thickness t which is less than 1/10th of a wavelength of the radio frequency waves.

18. The polarization converting surface of claim 13 wherein the plurality of conductive elements are arranged in a planar array.

19. A method of tuning a high impedance surface for a radio frequency signal comprising:

arranging a plurality of generally spaced-apart conductive elements in at least one array disposed essentially parallel to and spaced from a conductive back plane, the size of each conductive element along a major axis thereof being less than a wavelength of the radio frequency signal and the spacing of each conductive surface from the back plane being less than a wavelength of the radio frequency signal, the array having at least two major axes; and varying the capacitance between adjacent conductive surfaces in the array in the two major axes thereof to thereby tune the impedance of said high impedance surface to have different resonant frequencies in said two major axes and to have different pass bands in the two major axes, the two different pass bands partially overlapping each other.

20. The method of claim 19 wherein said plurality of generally spaced-apart conductive elements are arranged on a substrate.

21. The method of claim 20 wherein said substrate is a planar substrate.

22. The method of claim 20 wherein said plurality of generally spaced-apart conductive elements are arranged on a plurality of substrates, each substrate of said plurality of substrates bearing a different array of said conductive elements.

23. The method of claim 22 wherein said plurality of substrates is a plurality of planar substrates.

24. A surface for reflecting a radio frequency beam, the surface comprising:

(a) a ground plane;

(b) a plurality of conductive elements disposed in an array spaced from the ground plane, the at least one array having two major axes associated therewith; and (c) the conductive elements, in combination with the ground plane, having different frequencies associated with a reflection phase of zero phase in said two major axes.

25. The surface of claim 24 further including an substrate having first and second major surfaces, said substrate supporting at least selected ones of said plurality of conductive elements on said first major surface thereof and supporting said ground plane on the second major surface thereof.

26. The surface of claim 25 wherein at least selected ones of said plurality of conductive elements are connected to said ground plane by conductors routed through said substrate.

27. The surface of claim 25 wherein the substrate is a printed circuit board insulator.

28. The surface of claim 25 wherein the plurality of conductive elements each have an outside dimension which is less than the wavelength of the radio frequency beam.

29. The surface of claim 28 wherein the substrate has a thickness t which is less than 1/10th of the wavelength of the radio frequency beam.

30. The surface of claim 24 wherein the surface is a polarization converting reflecting surface for changing the polarization of the radio frequency beam from circular to linear and/or from linear to circular, wherein the plurality of conductive elements have a first bandwidth corresponding to a range of frequencies were the reflection phase falls between $-\pi/2$ and $+\pi/2$ in a first one of said two major axes and a second bandwidth corresponding to a range of frequencies were the reflection phase falls between $-\pi/2$ and $+\pi/2$ in a second one of said two major axes and wherein the first and second bandwidths partially overlap.

31. The surface of claim 30 wherein one of said first and second bandwidths includes higher frequencies than does the other of said first and second bandwidths and wherein a lower half of said one bandwidth coincides with an upper half of said other bandwidth.

32. A method of changing polarization of a radio frequency beam comprising:

providing a surface comprising:

(a) a ground plane;

(b) a plurality of conductive elements disposed in at least one array parallel to said ground plane and spaced from the ground plane, the at least one array being spaced a distance from the ground plane which is less than a wavelength of the radio frequency beam, the at least one array having two major axes associated therewith; and (c) the conductive elements being arranged with different sheet capacitances in said two major axes; and reflecting the radio frequency beam from said surface.

33. The method of claim 32 wherein the surface further includes an substrate having first and second major surfaces, said substrate supporting said at least one array on said first major surface thereof and supporting said ground plane on the second major surface thereof.

34. The method of claim 33 wherein at least selected ones of said plurality of conductive elements are connected to said ground plane by conductors routed through said substrate.

35. The method of claim 34 wherein the plurality of conductive elements each have an outside dimension which is less than the wavelength of the radio frequency beam.

36. The method of claim 33 wherein the substrate has a thickness t which is less than 1/10th of the wavelength of the radio frequency beam.

37. The method of claim 36 wherein the surface is a polarization converting reflecting surface for changing the polarization of the radio frequency beam from circular to linear and/or from linear to circular, wherein the top plates have a first bandwidth corresponding to a range of frequencies were the reflection phase falls between $-\pi/2$ and $+\pi/2$ in a first one of said two major axes and a second bandwidth corresponding to a range of frequencies were the reflection phase falls between $-\pi/2$ and $+\pi/2$ in a second one of said two major axes and wherein the first and second bandwidths partially overlap.

38. The method of claim 37 wherein one of said first and second bandwidths includes higher frequencies than does the other of said first and second bandwidths and wherein the lower half of said one bandwidth coincides with an upper half of said other bandwidth.

39. The method of claim 38 wherein the insulator is a printed circuit board insulator.

40. The method of claim 33 further including a second substrate, the first-mentioned substrate supporting a first array of said conductive elements and the second substrate supporting a second array of said conductive elements, the conductive elements of the first and second arrays at least partially overlying each other.

41. The method of claim 40 wherein the surface is a polarization converting reflecting surface for changing the polarization of the radio frequency beam from circular to linear and/or from linear to circular, wherein the top plates have a first bandwidth corresponding to a range of frequencies were the reflection phase falls between $-\pi/2$ and $+\pi/2$ in a first one of said two major axes and a second bandwidth corresponding to a range of frequencies were the reflection phase falls between $-\pi/2$ and $+\pi/2$ in a second one of said two major axes and wherein the first and second bandwidths partially overlap.

42. A surface for reflecting a radio frequency beam and for changing the polarization of the reflected radio frequency beam, the surface comprising:

(a) a ground plane;

(b) a plurality of conductive elements disposed in an array spaced from and parallel to the ground plane, the at least one array having two major axes associated therewith; and (c) the conductive elements, in combination with the ground plane, having different frequencies associated with a reflection phase of zero phase in said two major axes.

43. The surface of claim 42 further including an substrate having first and second major surfaces, said substrate supporting said array on said first major surface thereof and supporting said ground plane on the second major surface thereof.

44. The surface of claim 43 wherein at least selected ones of said plurality of conductive elements in said array are connected to said ground plane by conductors routed through said substrate.

45. The surface of claim 43 wherein the substrate comprises a printed circuit board.

46. The surface of claim 43 wherein the plurality of conductive elements each have an outside dimension which is less than the wavelength of the radio frequency beam.

47. The surface of claim 46 wherein the substrate has a thickness t which is less than 1/10th of the wavelength of the radio frequency beam.

48. The surface of claim 42 wherein the surface is a polarization converting reflecting surface for changing the polarization of the radio frequency beam from circular to linear and/or from linear to circular, wherein the top plates have a first bandwidth corresponding to a range of frequencies were the reflection phase falls between $-\pi/2$ and $+\pi/2$ in a first one of said two major axes and a second bandwidth corresponding to a range of frequencies were the reflection phase falls between $-\pi/2$ and $+\pi/2$ in a second one of said two major axes and wherein the first and second bandwidths partially overlap.

49. The surface of claim 48 wherein one of said first and second bandwidths includes higher frequencies than does the other of said first and second bandwidths and wherein the lower half of said one bandwidth coincides with an upper half of said other bandwidth.

50. The surface of claim 1 further including an substrate having first and second major surfaces, said substrate supporting said array of conductive elements on said first major surface thereof and supporting said ground plane on the second major surface thereof.

51. The surface of claim 50 wherein at least selected ones of said plurality of conductive elements in said array are connected to said ground plane by conductors disposed through said substrate.

* * * * *